US007812734B2

(12) United States Patent
Hardin

(10) Patent No.: US 7,812,734 B2
(45) Date of Patent: Oct. 12, 2010

(54) ALARM SYSTEM EMPLOYING EXISTING CONDUCTIVE ASPECT OF COPPER LINES AS WELL AS OPTIONAL PRESSURE SWITCH SENSOR FOR TRIGGERING A COPPER THEFT EVENT

(76) Inventor: Ken Hardin, 2317 Corunna Rd., Flint, MI (US) 48503

( * ) Notice: Subject to any disclaimer, the term of this patent is extended or adjusted under 35 U.S.C. 154(b) by 432 days.

(21) Appl. No.: 11/961,596

(22) Filed: Dec. 20, 2007

(65) Prior Publication Data

US 2009/0160661 A1 Jun. 25, 2009

(51) Int. Cl.
*G08B 21/00* (2006.01)

(52) U.S. Cl. ..... 340/652; 340/568.2

(58) Field of Classification Search ..... 340/652, 340/568.2; 62/129, 260; 700/299, 301; 24/305
See application file for complete search history.

(56) References Cited

U.S. PATENT DOCUMENTS

| | | | | |
|---|---|---|---|---|
| 4,854,446 | A | 8/1989 | Strader | |
| 5,172,461 | A | 12/1992 | Pichl et al. | |
| 5,235,286 | A | 8/1993 | Masla et al. | |
| 5,631,634 | A | 5/1997 | Strelow | |
| 6,169,482 | B1 | 1/2001 | Altwasser et al. | |
| 6,462,668 | B1 | 10/2002 | Foseide et al. | |
| 6,865,941 | B2 | 3/2005 | Gibbs et al. | |
| 7,178,663 | B2 | 2/2007 | Schnell et al. | |
| 7,239,238 | B2 | 7/2007 | Tester et al. | |
| 7,274,289 | B2 | 9/2007 | Kerr et al. | |
| 2003/0193006 | A1 * | 10/2003 | Harris | 248/678 |
| 2003/0201892 | A1 * | 10/2003 | Chance et al. | 340/568.2 |
| 2005/0125102 | A1 * | 6/2005 | Nichols et al. | 700/276 |
| 2007/0089447 | A1 * | 4/2007 | Wiggs | 62/260 |
| 2009/0077984 | A1 * | 3/2009 | Tidrick | 62/129 |

* cited by examiner

*Primary Examiner*—Daniel Wu
*Assistant Examiner*—Shirley Lu
(74) *Attorney, Agent, or Firm*—Gifford, Krass, Sprinkle, Anderson & Citkowski, P.C.

(57) ABSTRACT

A theft preventative system, such as which is specifically associated with high resale value metals employed in heating, cooling and ventilation (HVAC) assemblies. A first embodiment utilizes a transformer and relay arrangement creating a closed circuit through the lines of conductive copper pipe, via interconnecting wires, and which is also hooked to an alarm for notifying when the metal conductive circuit to the copper line is opened, either by cutting the copper pipe or the wire connected to it. A second variant discloses incorporating a fluid pressure switch into each of the copper lines, for notifying when fluid pressure within the line decreases, this indicative of the normally fluid filled copper line being sectioned.

15 Claims, 2 Drawing Sheets

ALARM SYSTEM EMPLOYING EXISTING CONDUCTIVE ASPECT OF COPPER LINES AS WELL AS OPTIONAL PRESSURE SWITCH SENSOR FOR TRIGGERING A COPPER THEFT EVENT

FIELD OF THE INVENTION

The present invention relates generally to a theft preventative system, such as which is specifically associated with high resale value metals employed in heating, cooling and ventilation (HVAC) assemblies. More specifically, the present invention disclose a copper theft prevention system which, in a first embodiment, utilizes a transformer and relay arrangement creating a closed circuit through the lines of conductive copper pipe, and which is also hooked to an alarm of some type for notifying when the metal conductive circuit (e.g. the copper line or associated connecting wire) is opened, such as by sectioning. A second variant (additional or alternative to the primary) discloses incorporating at least one fluid pressure switch into one of the copper lines, for notifying when fluid pressure within the line decreases, this indicative of the normally fluid filled copper line being sectioned.

BACKGROUND OF THE INVENTION

The prior art is documented with examples of alarm related systems for protecting valuables. In each instance, the objective of such systems is to deter the theft of typically unattended valuables.

Kerr et al. (U.S. Pat. No. 7,274,289) teaches a pattern of conductors extending in spaced, isolated fashion across each surface of an object, and in order to define a tamper detection area. At least one sensor device is connected to the pattern of conductors and is capable of detecting a change in the continuity of pattern of the conductors. A communication circuit provides at least one signal indicative of a change in the continuity of the pattern of conductors.

Schnell (U.S. Pat. No. 7,178,663) teaches a conductor loop, such as embedded into a polymer, and including individual wires defining a component of a transport belt and which further includes a conductor loop with a support side, running side and embedded tensile support. U.S. Strader (U.S. Pat. No. 4,854,446) discloses a conveyor belt having an electrically conductive sensor or antenna embedded within and which, in the instance of a rip being detected in the belt, acts to interrupt a repeating sine wave created by the conductor. Finally, the Strelow (U.S. Pat. No. 5,631,634) and Gibbs (U.S. Pat. No. 6,895,941) references are directed to pressure sensor and liquid leak detection systems, respectively, each providing alarm notification in the event of a pipe rupture.

SUMMARY OF THE INVENTION

The present invention teaches a theft preventative system associated with protecting valuable metals, such as in particular copper lines incorporated into various HVAC applications, and which have been found to yield high scrap resale. As a result of this, incidences of copper theft have significantly risen, particularly in environments where such materials are loosely attended or completely unattended.

In a first embodiment, a transformer and relay arrangement is provided which creates a closed circuit through one or more lines of conductive copper pipe, such as extending between a first (interiorly) located piece of equipment, such as a furnace refrigeration coil, and a second (externally) located piece of equipment, such as a ground or rooftop mounted condensing unit. Wires extend from such as a 12 V DC transformer and contact locations associated with each of the copper lines. Owing to the electrically communicative/conductive nature of copper, the closed circuit thereby created extends throughout the entire length of all such lines communicated in this fashion.

An alarm is further communicated to a relay (such as a 12 V DC coil relay) and, upon detecting an open circuit condition indicative of a copper line being sectioned (such as during unauthorized theft removal) issues an alarm to such as a siren (and which is understood to include any or all of an audio output, a strobe light, and a remote notification of a theft in progress).

A second variant (additional or alternative to the primary electrically conductive version) incorporates one or more fluid pressure switches into each of the copper lines. As with the electrical lines associated with applying a conductive field to the copper lines, additional lines likewise communicate the fluid pressure switch to the transformer/relay. Upon the switch detecting a reduction or total loss of fluid pressure within a selected line, this indicative of the normally fluid filled copper line being sectioned, the flow sensor switch issues a signal for activating the alarm protocol as previously described.

BRIEF DESCRIPTION OF THE DRAWINGS

Reference will now be made to the attached drawings, when read in combination with the following detailed description, wherein like references refer to like parts throughout the several views, and in which.

DETAILED DESCRIPTION OF THE PREFERRED EMBODIMENTS

Figure 1:
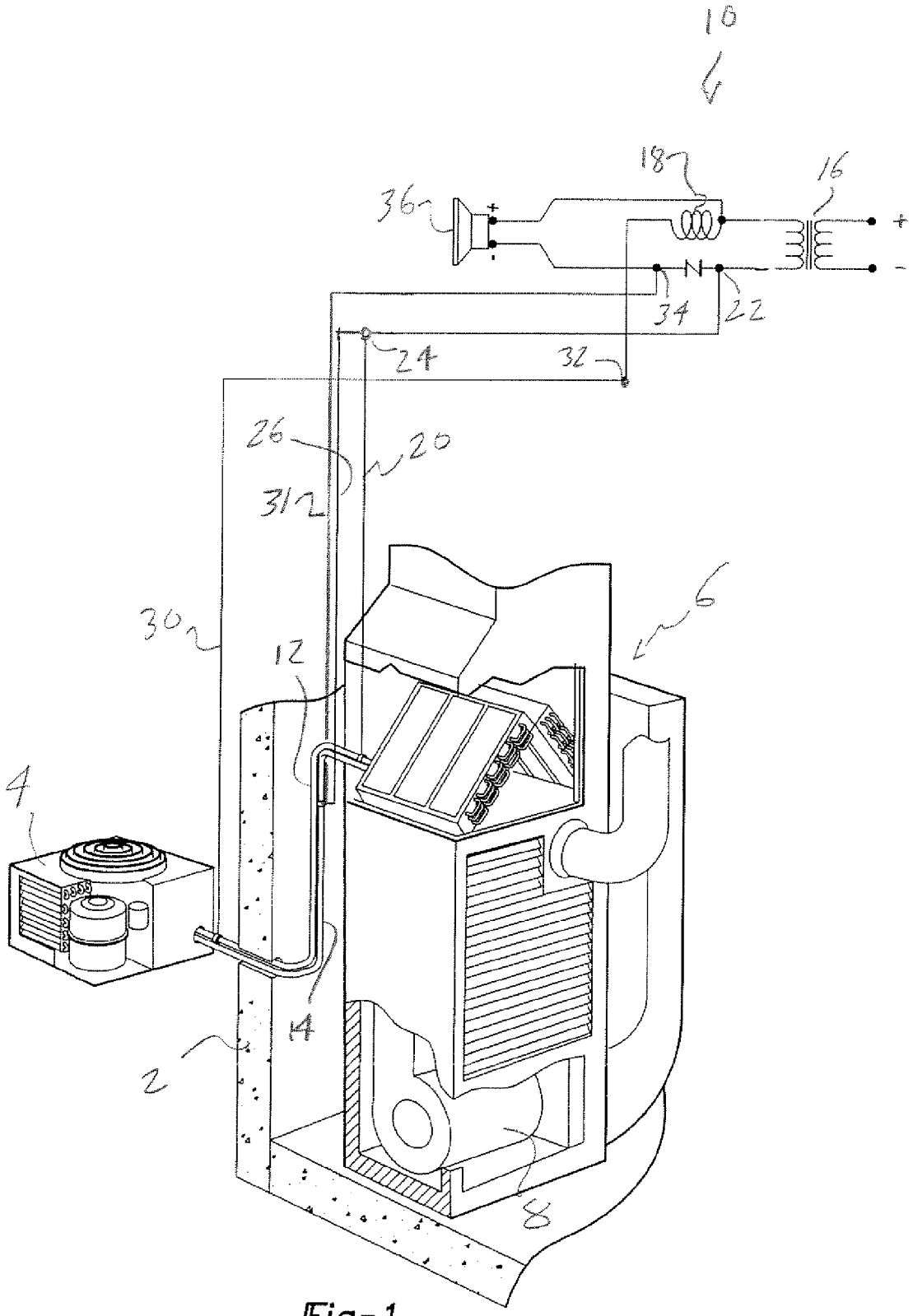
FIG. 1 is an environmental illustration in perspective of an electrical conductive circuit associated with copper lines as part of a theft preventative alarm system according to a first preferred embodiment of the present invention.
Figure 2:
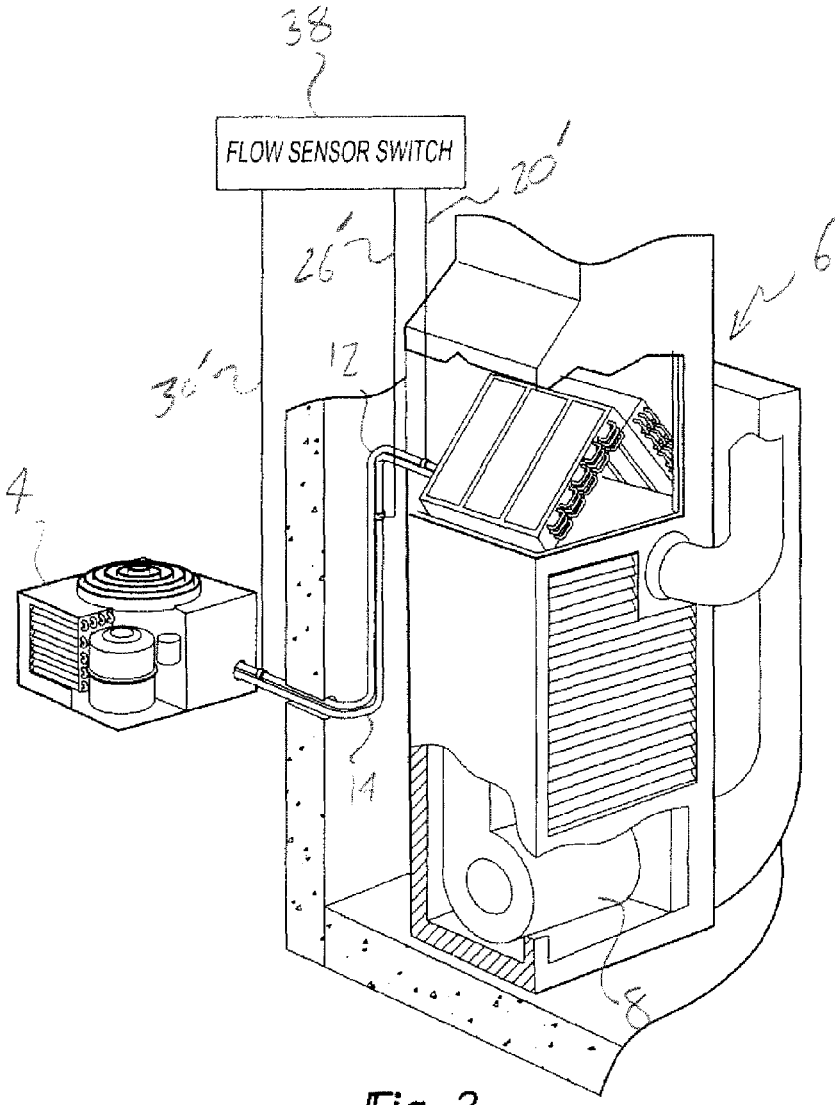
FIG. 2 is an environmental perspective according to an alternate preferred embodiment and in which substitutes a pressure flow sensor switch for notifying of an alarm situation resulting from cutting of one or more of the copper lines.
Figure 3:
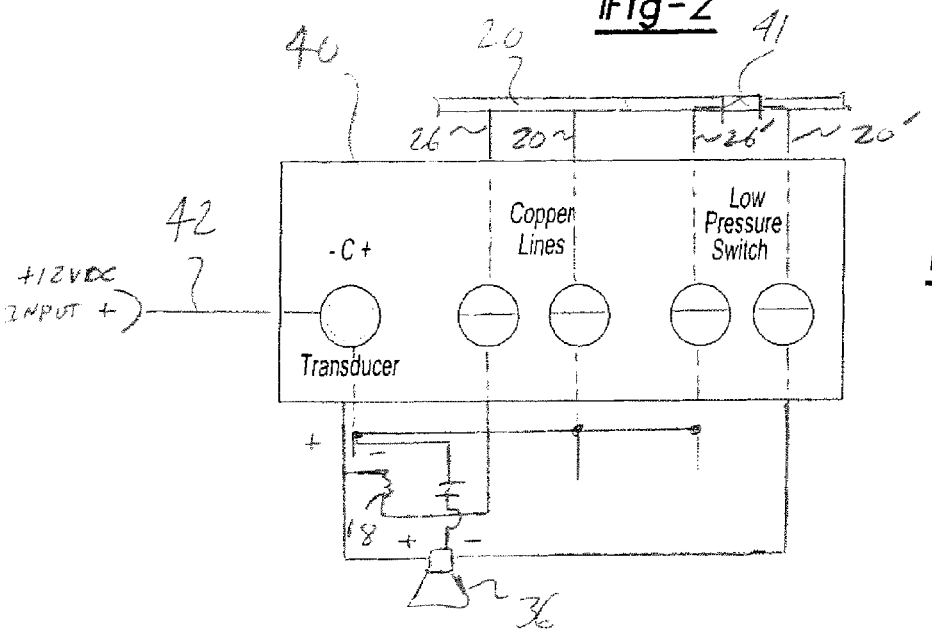
FIG. 3 is a sectional view of an alarm control interface and exhibiting contact locations for both the circuit associated with the electrically conductive copper lines, as well as for the low pressure switch according to the present inventions.

Referring now to FIGS. 1-3, the present invention teaches a theft preventative system associated with protecting valuable metals, such as in particular copper lines incorporated into various HVAC applications. As previously explained, the present inventions are intended to provide an efficient and cost effective solution for addressing an alarm situation involving such as high resale valued copper used in existing HVAC applications. Another advantage of the present invention is the ability to incorporate the alarm capabilities for detecting copper theft into existing intrusion and smoke/fire alarms.

Referring again to FIG. 1, an environmental illustration in perspective, at 10, of an electrical conductive circuit associated a theft preventative alarm system communicated with copper lines 12 and 14. A transformer 16 and relay arrangement 18 are collectively provided (each typically including a 12V DC power supply). A first contact wire 20 extends from a location associated with the first copper line 12 and branches to further contact (also pressure switch) locations 22 and 24 associated with the relay 18. A second contract wire 26 extends from a further location associated with the second copper line 14 and branches to a contact location 24 associated with an opposite (+) pole of the relay coil 18 to transformer 16 interface.

The first 20 and second 26 wires extend from interior locations associated with the HVAC assembly, see wall 2. A Third 30 and fourth 31 wires are further shown extending from an exterior location of line 12, such as wire 30 extending in proximity to an exteriorly located condensing unit 4, and connecting directly, at connection 32, to the coil relay 18, as well as wire 31 extending from connection 34, to the negative pole interface of the transformer 16.

The arrangement of the wires 20, 26 [and] 30 and 31 (T1 wire) are such that they create a closed circuit (of sufficiently low voltage and current to avoid inadvertent electrocution or harm) through each of the lines of conductive copper pipe (e.g. again at 12 and 14), such as extending between a first (interiorly) located piece of equipment, such as a furnace as generally referenced at 6 and including a refrigeration coil 8, and a second (externally) located piece of equipment, such as again a ground or rooftop mounted (air conditioning) condensing unit 4. It is further understood and envisioned that the arrangement of the wires to the various copper lines takes into account the possibility of varied HVAC installation configurations, and which may include multiple numbers of copper lines being used, particularly in situations where multiple condenser units are specified for operating in a parallel arrangement. In such a configuration, additional pairs of wires would be employed and which would extend from such as the 12 V DC transformer 16 and contact locations associated with each of the copper lines.

Owing to the electrically communicative/conductive nature of copper, and upon providing 12V DC charge from the transformer to the various wires, the closed circuit thereby created extends throughout the entire length of all such lines communicated in this fashion. An alarm, represented by siren 36, is further communicated to the relay. Upon detecting an open circuit condition, indicative of any of the electrically charged copper lines defining the closed circuit being sectioned (and such as during unauthorized theft removal), the alarm issues output to such as the siren 36, and which is understood to collectively represent each or all of an audio output, a strobe light, and a remote notification of a theft in progress. As previously described, the copper theft detection system can be configured so as to be seamlessly and effectively incorporated into an existing alarm system and, in a suitable retrofit embodiment, can include such as a kit for installing the desired wires to the existing lines and routed to a relay interface engageable with the existing alarm unit control panel.

Referring now to FIG. 2, an environmental perspective is shown of an alternate preferred embodiment and in which substitutes a pressure flow sensor switch 38, for the transformer and relay arrangement of FIG. 1, and for notifying of an alarm situation resulting from cutting of one or more of the copper lines 12 and 14. Although not described in specific detail, it is understood that the pressure switch component associated with contact locations of the individual copper lines 12 and 14 contemplates installing a low pressure or micro switch sensor in contact with the fluidic interior of the copper fluid line, this occurring through any one of a number of different installation techniques. Identical features represented in the variant of FIG. 1 are similarly referenced here, a duplicate explanation of which is not necessary.

It is also understood that the secondary variant of pressure flow indicating switch can be provided as an additional or alternative to the primary electrically conductive version, and which incorporates one or more fluid pressure switches into each of the copper lines. In certain applications, an exclusively low flow pressure alarm can be substituted, such as in use with non-electrically conducting fluid lines such as constructed of PVC or the like.

As with the electrical lines associated with applying a conductive field to the copper lines, corresponding or additional lines (referenced at 20', 26' and 30' for purposes of ease and consistency of illustration) likewise communicate the fluid pressure switch 38 to the transformer/relay arrangement (not shown). It is further understood that the pressure switch variant requires only two wires, as opposed to the arrangement illustrated in FIG. 1 as directed to the conductive arrangement of the initially disclosed variant. Upon the flow sensor switch 38 detecting a reduction or total loss of fluid pressure within a selected line, this indicative of the normally fluid filled copper line being sectioned, the flow sensor switch issues a signal for activating the alarm protocol (e.g. siren, retrofitted alarm panel, or the like) and according to a fashion as previously described.

Referring finally to FIG. 3, a sectional view is provided of an alarm control interface 40 (representative of the transformer supplied relay arrangement referenced in FIG. 1) and exhibiting various contact locations for both the circuit associated with the electrically conductive copper lines, as well as for the low pressure switch. In one preferred application, the interlace 40 can be provided as a terminal strip for applying such as to an outside of a siren box or other existing alarm installation.

A representative copper line is again shown at 20 and from which respective pairs of connective wires (see by example at 26 and 20 in regards to the electrically communicating lines and further at 26' and 20' in regards to the low flow pressure sensing switches) extend. Also referenced at 41 is a low pressure switch 41, this responding to a gradual or abrupt decrease in pressure in order to close and instruct the relay/transformer and alarm components. A 12 V DC power input is again referenced at 42 and additional features associated with the wiring, relay and siren are disclosed similar to that previously referenced in the description of FIG. 1.

It is also understood that additional terminal strips can be incorporated into the assembly, as well as adding or substituting a likewise 12 V DC powered strobe light as an additional deterrent. It is further envisioned that the alarm can be wired with an APC chip in substitution for the relay.

Accordingly, the present invention discloses a novel assembly for protecting against theft valuable copper lines associated with existing HVAC applications. A secondary benefit associated with the present system is the ability to notify of problems associated with the copper fluid lines, not resulting from theft, and such as in instances where inadvertent damage, for example resulting from acts of nature, are inflicted upon the copper lines. In such a secondary application, the use of low flow pressure indicating (micro) switches is of particular value and in order to identify when fluid line integrity has been compromised. It is also envisioned that normally open pressure switches can be employed in another alternate variant.

Having described my invention, other and additional preferred embodiments will become apparent to those skilled in the art to which it pertains, and without department from the scope of the appended claims.

I claim:

1. A redundant anti-theft alarm system for existing fluid lines, said alarm system comprising:

a plurality of wires extending from each of a plurality of fluid carrying copper lines, said wires electrically conducting a closed circuit with each the copper lines to a terminal incorporated into a power supplied relay and transformer; and an interior of each of the fluid lines further incorporating a low pressure switch in separate communication with said wires;

upon receipt of a fault signal indicative of either or both an interruption of a closed circuit and a loss of pressure in any one of the fluid lines, caused by one of theft or removal of the copper lines, said relay instructing an alarm output.

2. The alarm system as described in claim 1, further comprising at least one of a siren and a strobe light output in communication with said relay and transformer.

3. The alarm system as described in claim 1, further comprising a plurality of terminals incorporated into a terminal strip mounted to an exterior surface of an audio siren operatively connected to the power supply.

4. The alarm system as described in claim 1, the fluid lines further including at least a pair of copper lines extending between an interior located refrigeration coil and an exterior located condensing unit, associated wires extending to positive and negative poles associated with said relay and transformer.

5. The alarm system as described in claim 2, each of said relay and transformer and said siren having a specified shape and size and further comprising a 12 V DC power supply.

6. A redundant anti-theft alarm system for existing copper fluid lines incorporated into an existing HVAC system, comprising:

a plurality of wires extending from each of a plurality of fluid lines and communicating with associated terminals incorporated into a power supplied relay and transformer, said wires supplying an electrically conductive field to each of said copper fluid lines and separately communicating with a low pressure switch contained within each of the fluid lines;

an alarm operatively communicated with said relay and transformer; and upon receipt of a fault signal indicative of compromise of integrity in the fluid line, resulting from at least one of an opening of an electrical circuit established with each of said lines or a loss of fluid pressure, caused by one of theft or removal of the copper lines, said relay instructing said alarm to output an alarm signal.

7. The alarm system as described in claim 6, said alarm further comprising at least one of a siren and a strobe light output.

8. The alarm system as described in claim 6, further comprising a plurality of said terminals incorporated into a terminal strip mounted to an exterior surface of an audio siren associated with said alarm and operatively connected to the power supply.

9. The alarm system as described in claim 6, the fluid lines further including at least a pair of copper lines extending between an interior located coil and an exterior located condensing unit, associated wires extending to positive and negative poles associated with said relay and transformer.

10. The alarm system as described in claim 7, each of said relay and transformer and said siren having a specified shape and size and further comprising a 12 V DC power supply.

11. A redundant anti-theft alarm system for existing fluid lines incorporated into an existing HVAC system, comprising:

a plurality of wires, each extending from a selected one of a plurality of fluid lines and at locations associated with a fluid pressure detecting switch incorporated into each of the fluid lines, said wires additionally electrically conducting a closed circuit with each of the line and further communicating with associated terminals incorporated into a power supplied relay and transformer;

an alarm operatively communicated with said relay and transformer; and upon receipt of a fault signal indicative of compromise of integrity in the fluid line corresponding to either or both an interruption of said closed circuit and a loss of fluid pressure, caused by one of theft or removal of the copper lines, said relay instructing said alarm to output an alarm signal.

12. The alarm system as described in claim 11, said alarm further comprising at least one of a siren and a strobe light output.

13. The alarm system as described in claim 11, further comprising a plurality of said terminals incorporated into a terminal strip mounted to an exterior surface of an audio siren associated with said alarm and operatively connected to the power supply.

14. The alarm system as described in claim 11, the fluid lines extending between an interior located refrigeration coil and an exterior located condensing unit, associated wires extending to positive and negative poles associated with said relay and transformer.

15. The alarm system as described in claim 12, each of said relay and transformer and said siren having a specified shape and size and further comprising a 12 V DC power supply.

* * * * *